US012232610B1

(12) United States Patent
Wilkinson

(10) Patent No.: US 12,232,610 B1
(45) Date of Patent: Feb. 25, 2025

(54) MODULAR SORTING ASSEMBLY FOR PRINT AND DIGITAL MEDIA

(71) Applicant: Ben Wilkinson, Sandy Lake, PA (US)

(72) Inventor: Ben Wilkinson, Sandy Lake, PA (US)

( * ) Notice: Subject to any disclaimer, the term of this patent is extended or adjusted under 35 U.S.C. 154(b) by 544 days.

(21) Appl. No.: 17/505,442

(22) Filed: Oct. 19, 2021

Related U.S. Application Data

(60) Provisional application No. 63/093,857, filed on Oct. 20, 2020.

(51) Int. Cl.
*A47B 37/00* (2006.01)
*A47B 83/00* (2006.01)

(52) U.S. Cl.
CPC ..... *A47B 37/00* (2013.01); *A47B 83/001* (2013.01)

(58) Field of Classification Search
CPC ..... A47B 37/00; A47B 83/001
See application file for complete search history.

(56) References Cited

U.S. PATENT DOCUMENTS 1,299,331 A * 4/1919 Gydesen ..... A47B 83/001 312/304
3,920,299 A * 11/1975 Propst ..... B01L 9/02 312/107
4,544,214 A * 10/1985 Nizel ..... B01L 9/02 312/228
4,586,759 A * 5/1986 Wrobel ..... A47B 96/067 312/246
4,712,842 A * 12/1987 Price ..... A47B 83/001 312/325
4,974,915 A * 12/1990 Bussard ..... A47B 83/001 108/50.11
D335,780 S * 5/1993 Gordon ..... D6/699
5,522,324 A * 6/1996 van Gelder ..... A47B 37/00 108/50.02
5,694,862 A * 12/1997 Grubb ..... A47B 83/001 312/196
5,738,422 A * 4/1998 Welborn, Jr. ..... A47B 83/001 312/196
5,791,751 A * 8/1998 Meyer ..... A47B 83/001 312/317.3
6,115,978 A * 9/2000 Bastian ..... E04B 2/7455 52/36.5
7,634,967 B1 * 12/2009 Albright ..... B01L 9/02 52/220.8
8,186,281 B2 * 5/2012 Bastian ..... A47B 83/001 108/50.02
9,215,924 B2 * 12/2015 Seefeldt ..... A47B 21/06
(Continued)

*Primary Examiner* — Ko H Chan
(74) *Attorney, Agent, or Firm* — Karen Tang-Wai Sutton

(57) ABSTRACT

A modular, scalable sorting assembly for sorting items into boxes, comprising two sorting level units, each unit having accessible work spaces on both front and back sides, and with a work surface dividing each unit into upper and lower storage areas with through-slots formed into a lower storage area of each unit sized and shaped to store and receive one or more uniformly sized and shaped open top boxes. The upper storage area has a series of shelves sized and shaped to store items prior to sorting or after being sorted but prior to placement in the boxes. One of the two units is further comprised of a central workstation and a wing with a side wall configuration that angles the wing towards an area directly in front of the central workstation when the wing is positioned immediately adjacent thereto.

14 Claims, 10 Drawing Sheets

(56) References Cited

U.S. PATENT DOCUMENTS

| | | | | |
|---|---|---|---|---|
| 9,955,784 | B1 * | 5/2018 | Smith | F16M 11/22 |
| 10,779,640 | B2 * | 9/2020 | Allen | A47B 9/14 |
| 10,827,832 | B2 * | 11/2020 | Bonuccelli | A47B 83/001 |
| 10,993,534 | B1 * | 5/2021 | Pike | A47B 13/08 |
| 2008/0030002 | A1 * | 2/2008 | Jakins | A47B 83/001 280/638 |
| 2015/0083028 | A1 * | 3/2015 | Bedard | A47B 37/00 108/156 |
| 2019/0183242 | A1 * | 6/2019 | Bonuccelli | A47B 21/06 |
| 2020/0163452 | A1 * | 5/2020 | Allen | A47B 9/20 |

* cited by examiner

MODULAR SORTING ASSEMBLY FOR PRINT AND DIGITAL MEDIA

CROSS-REFERENCE TO RELATED APPLICATIONS

This application claims priority and benefit to U.S. provisional application No. 63/093,857 filed on 20 Oct. 2020, which is in its entirety is incorporated by reference into this application.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The present invention pertains to apparatuses used in the field of sorting numerous miscellaneous unsorted print and nonprint items in the form of books, magazines, LPs, cassettes, and compact discs. Specifically, the invention is a modular, scalable sorting assembly for efficient and systematic organization of relatively large quantities of print, and digital and analogue media items.

Background Art

Used books, magazines, and audio and/or visual media in the form of vinyl records, compact discs and VHS tapes are uniquely problematic for libraries and other entities collecting such items in order to resell them to others for fundraising purposes. Each used item must be manually identified by title, then organized into like groupings. The nature of used books and media is such that the items are all individualized, meaning they differ in subject matter, condition, price, age, and size and hence are neither easily nor practically sorted by automated sorting machines or systems. In relatively small quantities, such as less than a hundred items, used media are manually sorted by one or two individuals using existing software to scan and retrieve basic information about the item, including current pricing for the used item based on its identification, age and condition, and then the item is physically positioned in a designated box or pile of same or like items. If the item is going to be sold, the grouping may be for items of a same price (all items $5 for instance), a same type of item (music cds, or magazines, for instance), a same subject (history books, for instance), or any other type of useful grouping. This manual process is easily performed on a table, where like items are simply grouped together according to their desired groupings after each item is identified and sorted.

The problem with this manual process is that it is not easily or efficiently scalable to accommodate large volumes of media, such as when many hundreds or thousands of books, magazines, movie and music CDs, VHS tapes and vinyl records must be sorted and grouped. Manually sorting large volumes using known methods requires ample space and considerable physical labor. For a charity or other non-profit organization trying to hold a fundraiser, a used book and media sale with thousands, tens of thousands, and hundreds of thousands of used items can easily require a team of 30 or more people working several hours a day in a warehouse to sort the items for weeks. Worse, item sorting must be done prior to the sale, and typically this has resulted in all sorting being performed at the sale site, presenting logistical problems when the sale site lacks the space or manpower needed to sort the items, or when that space is required for other activities prior to the sale and cannot be cordoned off to allow the sorting to take place.

Additionally, used items are typically sold at a discounted price, and profit is difficult in circumstances where the organization lacks unpaid workers as the cost of paying workers to sort and group the used items may cost as much or more than the money that will be made by the sale of the sorted items. Hence, a used book and media sale often becomes a "rummage sale", where ungrouped and unsorted items are offered for sale and potential buyers must do the work of sorting and picking through the items. It is well known that presorting and presenting used books and other media for sale in organized and systematic ways increases sales, and hence the library or other entity holding the sale must carefully weigh the time and cost required to manually sort the items, and the desire to maximize sales.

What is needed is a sorting assembly that allows two or more people to systematically and efficiently sort and group large quantities of books and other physical media in a limited space.

What is also needed is a sorting assembly that is easily scalable to accommodate book and media volume and number of workers as needed.

What is also needed is a sorting assembly that is modular and transportable and thus easily adapted to any space as needed.

DISCLOSURE OF INVENTION

In a first aspect of the invention, a sorting assembly according to the invention is comprised of a first level sorting unit and a second level sorting unit. Either unit can be used alone to provide a single level or sorting, or more typically, the units are used together, along with a display unit and a storage unit after sorting is complete.

In a second aspect of the invention, the first level sorting unit features a doubled sided workstation with an upper shelving area for storage of sorted items, a work surface, and a series of slots sized and shaped to receive two boxes. A shelf for a computer is positioned centrally on each side of the first level sorting unit, with overhead lighting and power built into the unit. The second level sorting unit features a central station flanked by a pair of wing units angled to create a concave workstation such that a user standing in front of the central station can easily turn and access each wing efficiently. The second level sorting unit features upper shelving for sorted items and lower shelving or through slots sized and shaped to receive the boxes used in the first level sorting unit. The second level unit, like the first level unit, is fully accessible from either side and thus both units must be positioned away from a wall to allow the user access to both sides.

In a third aspect of the invention, the first level sorting unit is comprised of a pair of opposed lower side walls having a first edge shape towards the front work side and a second edge shape towards the back work side, allowing the user to visually identify each side of the unit.

In a fourth aspect of the invention, the second level sorting unit is modular and additional central stations and wings can be added as desired.

In a fifth aspect of the invention, the sorting assembly components are wheeled, allowing the units to be easily moved to accommodate different room sizes and area where sorting is occurring. The modular nature of the assembly allows the user to quickly set up, sort, and demobilize the units. The storage and display units, also wheeled, allow the user to set up a display for a sale quickly and easily, as well as breakdown the sale equally quickly.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
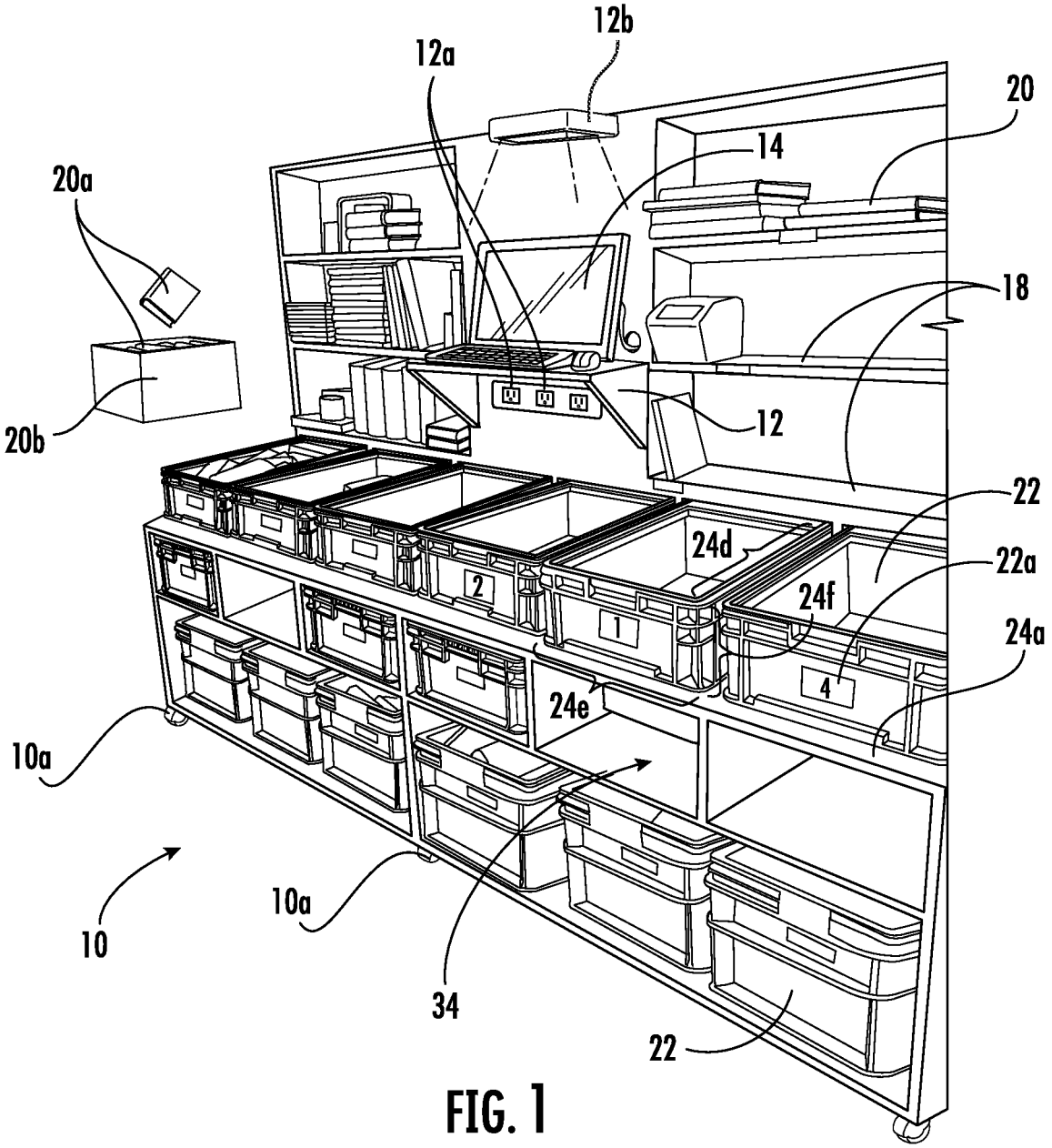
FIG. 1 is a perspective view of a front side of a first level sorting unit (GAP unit) according to the invention.
Figure 2:
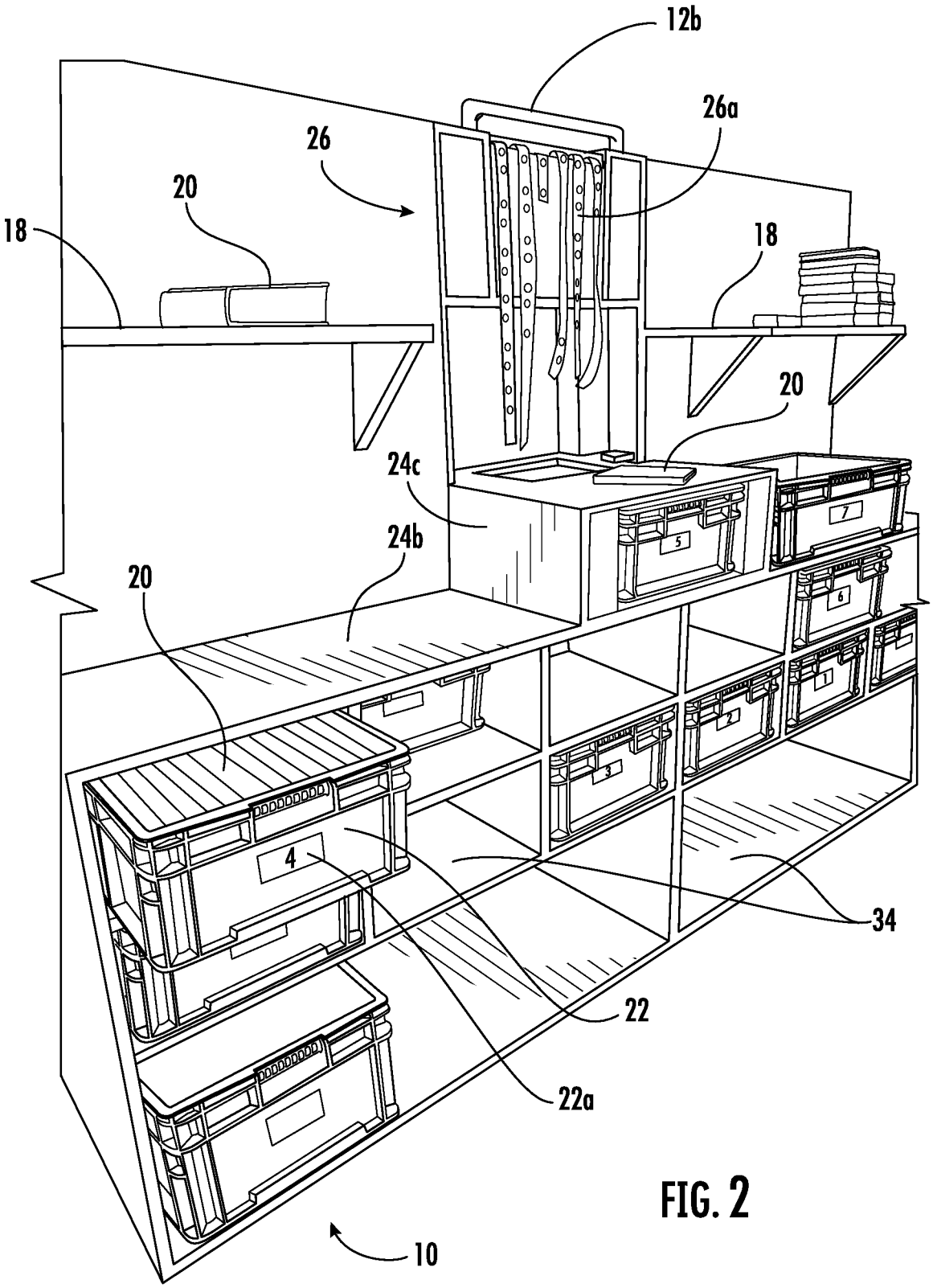
FIG. 2 is a perspective view of a back side of the GAP unit in FIG. 1.
Figure 3:
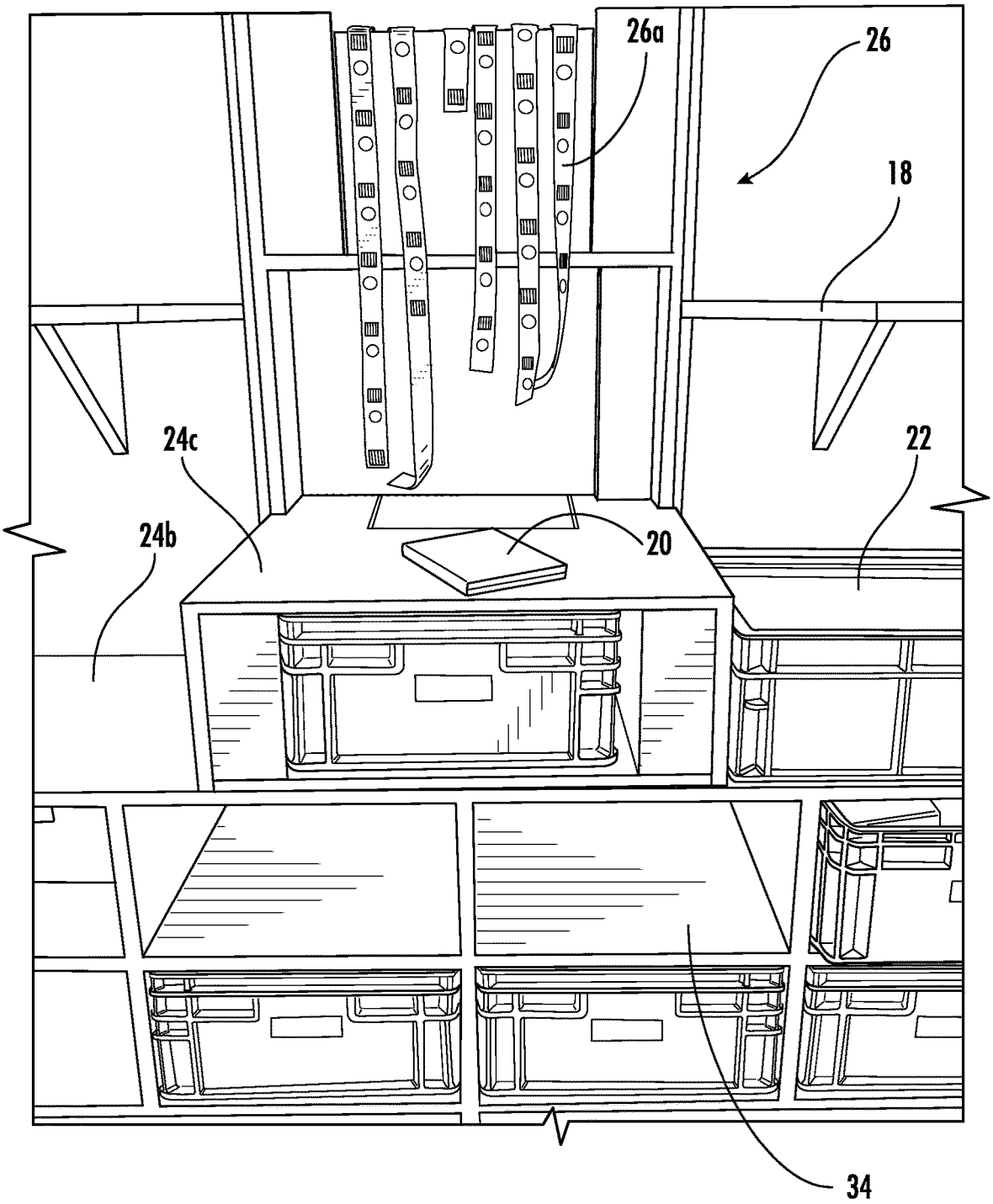
FIG. 3 is a back view of the GAP unit.

The following is a list of reference labels used in the drawings to label components of different embodiments of the invention, and the names of the indicated components.

100 sorting assembly
10 first level sorting unit or GAP unit
10*a* wheel/caster
12 workstation shelf
12*a* outlet/power (show usb ports etc.)
12*b* light
14 computer
18 GAP shelf
20 sorted item
20*a* unsorted item
20*b* unsorted item box
22 sorted item box
22*a* group designation
24*a* front work surface
24*b* back work surface
24*c* central portion
24*d* box length
24*e* box width
24*f* box height
26 workstation
26*a* labels
30 side of GAP shelves unit
32 angled wall
34 through-slot
36 side wall
40 second level sorting unit or SD unit
42 central workstation
42*a* sorting bay shelf
42*b* sorting shelf/through slot for sorted item box
44 side wing workstation or wing
50 work surface
52 drawer
60 display unit
62 storage drawer unit or storage unit or drawer unit

DETAILED DESCRIPTION

Figure 10:
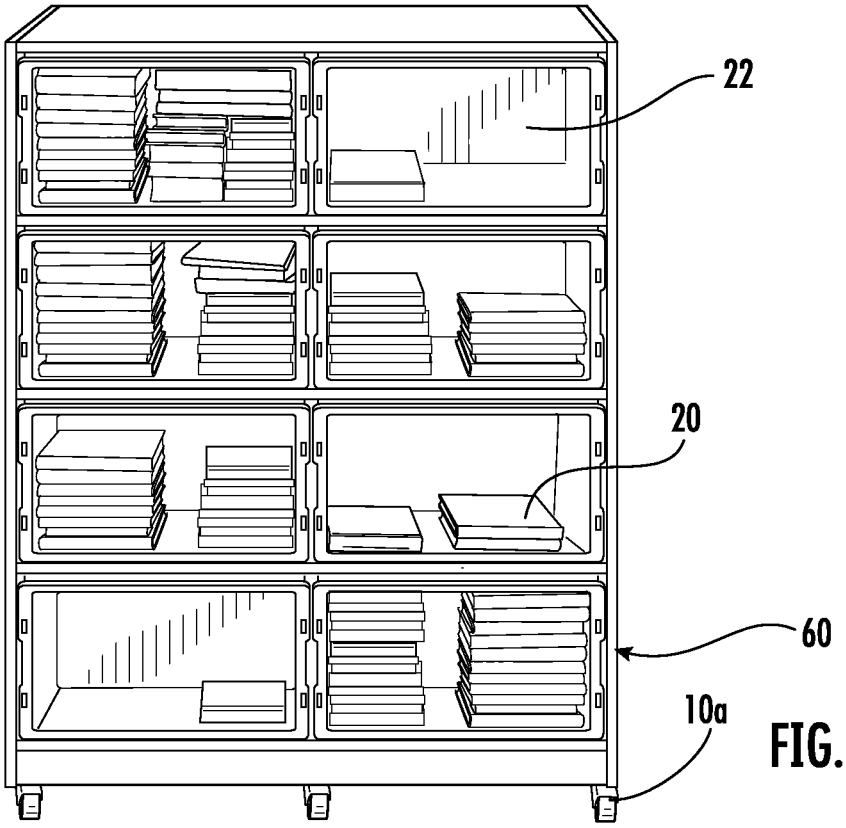
FIG. 10 is a sorting shelf unit for sorted item boxes.
Figure 11:
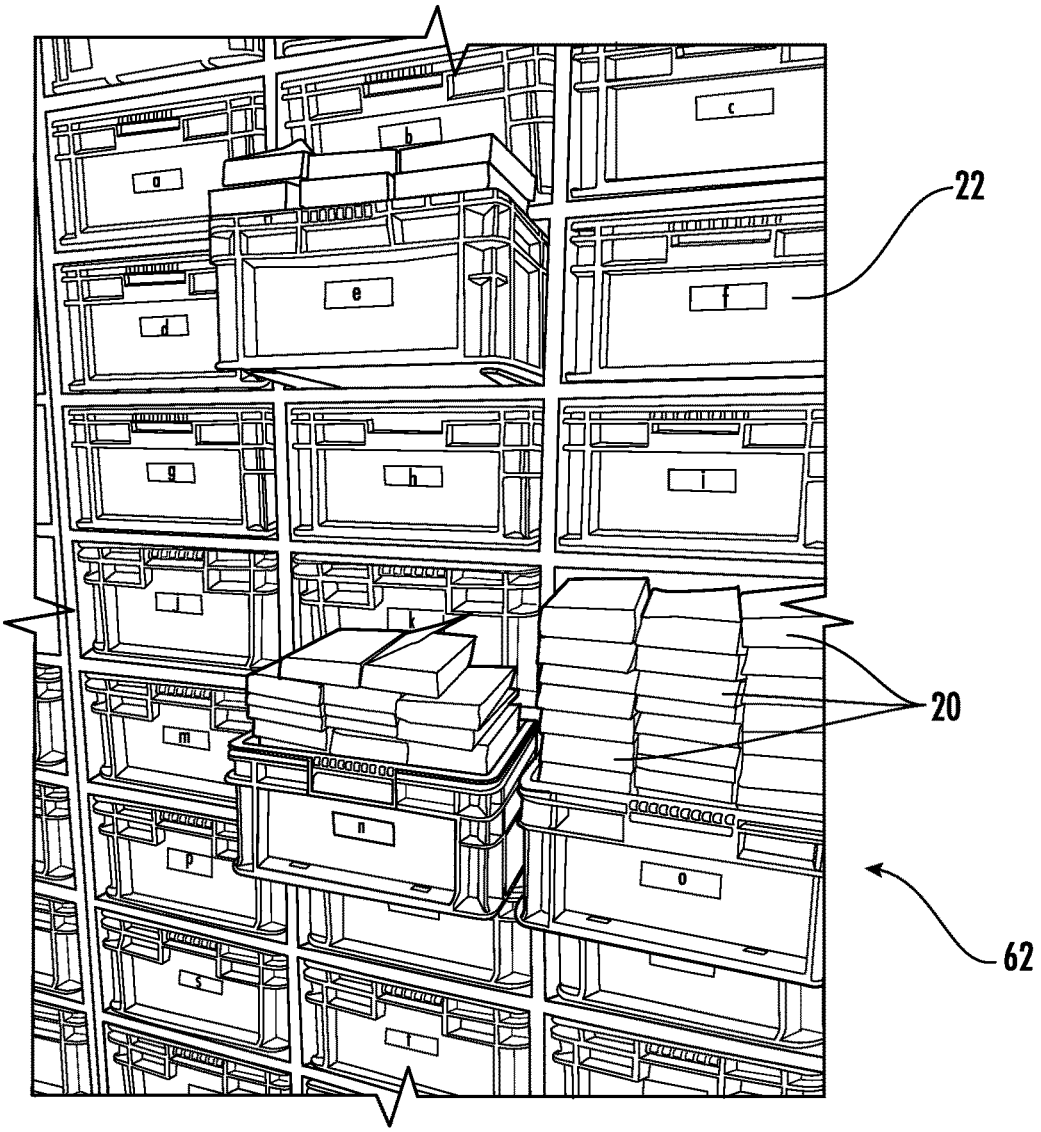
FIG. 11 is a drawer-style shelving unit for sorted item boxes.
Figure 12:
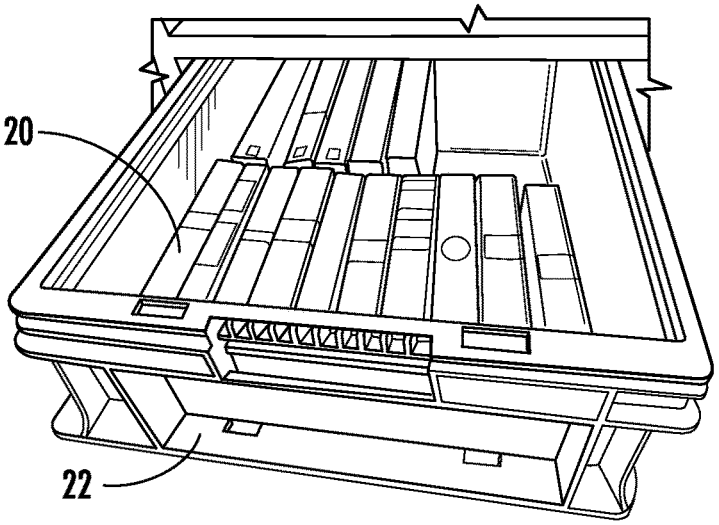
FIG. 12 is a detail view of a sorted item box for a drawer-style shelving unit.
Figure 13:
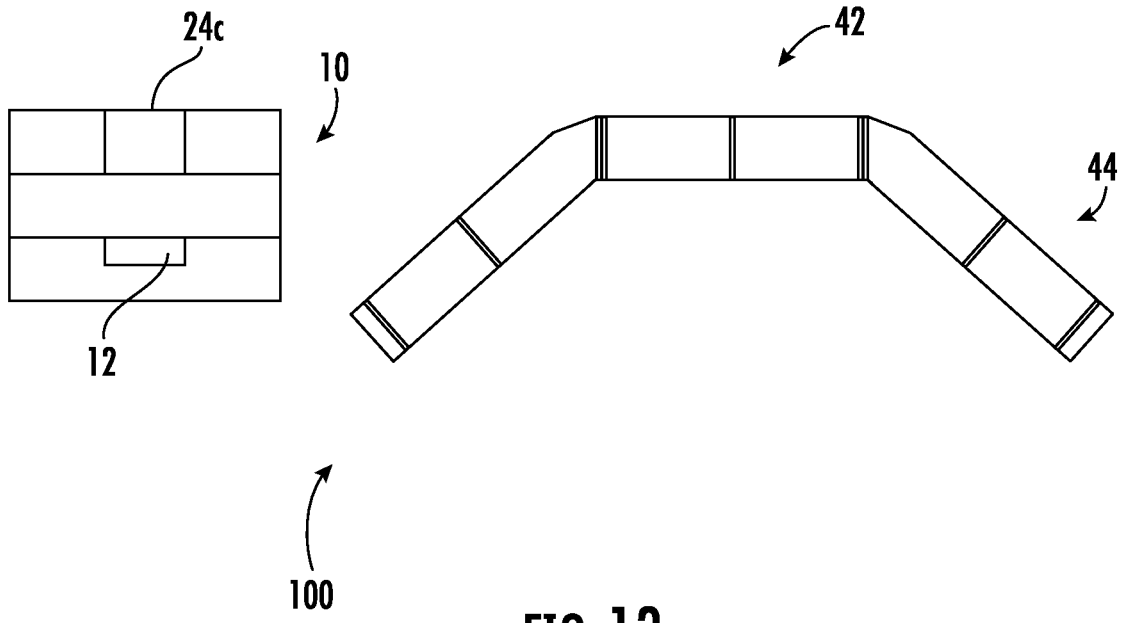
FIG. 13 is a top view of the sorting assembly according to the invention.

A sorting assembly according to the invention 100 is comprised of a first sorting unit or GAP unit 10 and a second sorting unit or SD unit 40, the assembly 100 shown in a top view in FIG. 13, with its individual components shown in more detail in FIGS. 1-9, with storage and display assemblies according to the invention shown in FIGS. 10-12.

Items typically sorted by the sorting assembly 100 are print and digital media such as books, magazines, movie DVDs, CDs, LPs, comics, and cassettes providing a user multiple levels of sorting and the ability to quickly and efficiently sort items to a degree similar to what is found in a library or a bookstore, where books and other items are commonly grouped by subject, author, audience age, etc. The storage and display assemblies 60 62 in FIGS. 9-12 allow the sorted items to be systematically stored, displayed and a sale set up and taken down quickly and easily.

Turning to the GAP unit 10 in FIGS. 1-5, the GAP unit 10 is a freestanding unit having a front side and a back side, an upper area and a lower area, the upper and lower areas separated by a front work surface 24*a*. The GAP unit 10 is provided with wheels 10*a* such as casters or other suitable wheels that allow the unit 10 to be moved as needed. The front side upper area is comprised of a plurality of shelves 18, including a centrally located workstation shelf 12 for supporting a computer 14 or other equipment. One or more power outlets 12*a* including USB and other useful ports are built directly into the GAP unit 10 to power lights 12*b*, equipment and other electronics. The shelves 18 span at least 30% of a length measurement of the GAP unit 10, and in the Figures is shown as being about ⅔ of the length measurement. The shelves 18 are minimally at least 11 inches deep, which is a standard shelf depth. Shelves 18 can be configured to be deep enough to securely hold vinyl record sleeves, for instance, or other bulky items. The front work surface 24*a* is sized and shaped to efficiently hold a plurality of sorted item boxes or boxes 22.

In the Figures, the boxes 22 are uniformly sized and shaped, with a box length 24*d*, a box width 24*e*, and a box height 24*f*. Boxes 22 shown in the Figures are rectangular in cross section i.e. cuboid, with the box length 24*d* dimension being larger than the box width 24*e* however square boxes i.e. cubes, could be used in some applications where all 4 sides have a same dimension and the slot 34 size, front and back work surfaces, etc. adjusted accordingly. Side walls of the box 22 must be of a durable enough construction to support the box 22 and its contents 20 when positioned on the box length 24*d*. The boxes 22 feature a lidless, open top and have a group designation 22*a* on each box 22 and in the Figures, the group designation is shown as numbers but note that it could also be colors, words, or other ways of differentiating the boxes from one another. In contrast, an unsorted item box 20*b*, holding unsorted items 20*a*, are typically cardboard boxes or other boxes of varying sizes and materials used simply to collect the unsorted items.

The front work surface 24*a* has a depth approximating one side of the box 22, and a length sized to efficiently accommodate a plurality of immediately adjacent boxes 22. The front work surface 24*a* plus a height of the box 22 together approximate a same height as a standard kitchen countertop to provide a comfortable work surface height. In practice, the height of the box 22 is tall enough to accommodate a majority of common book sizes. Below the front work surface 24*a*, the lower area is comprised of a series of vertically and horizontally adjacent through-slots or slots 34 sized and shaped to receive at least one and a maximum of two immediately adjacent boxes 22 positioned linearly within the slot 34. Boxes 22 are stored in the slots 34 where they are accessible from the front and back sides of the GAP unit 10.

Figure 4:
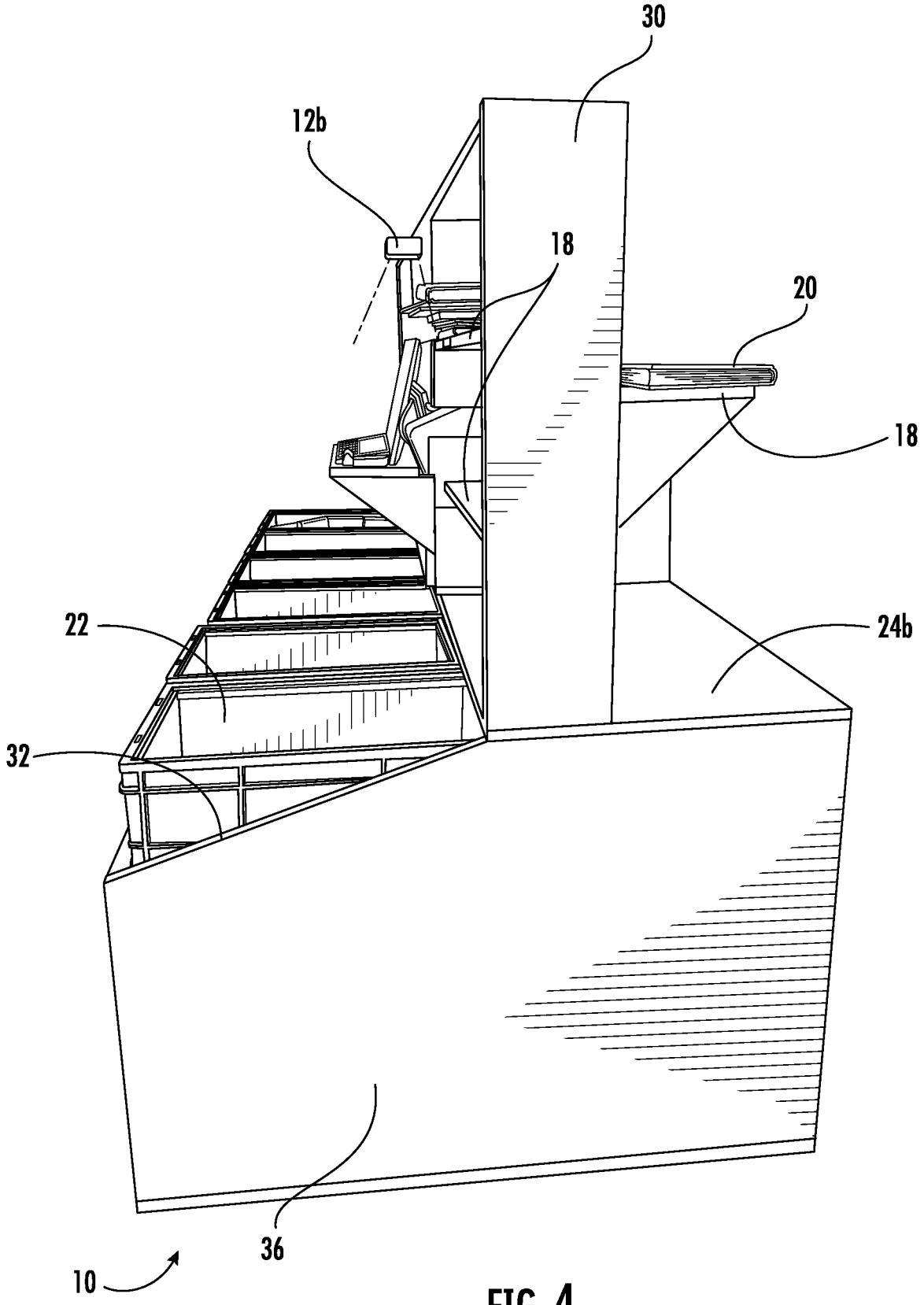
FIG. 4 is a side elevation view of the GAP unit.
Figure 5:
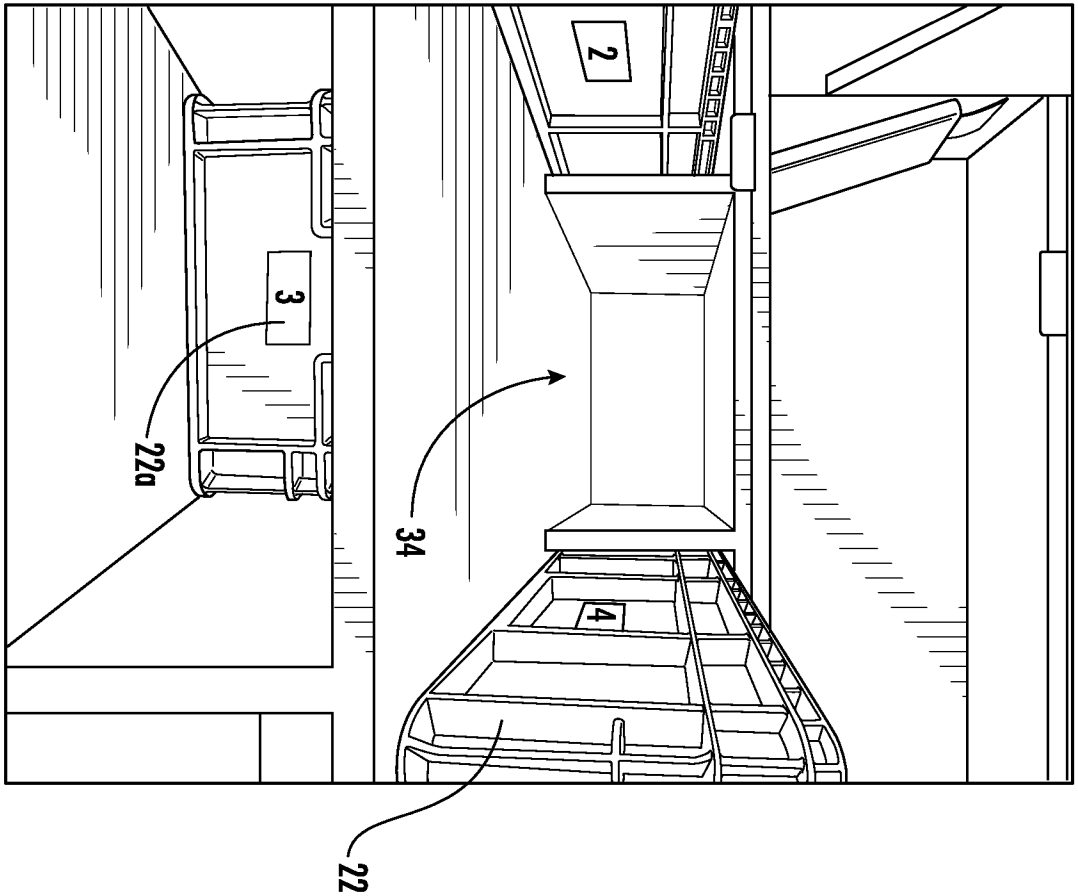
FIG. 5 is a detail view of a through-slot of the GAP unit.
Figure 6:
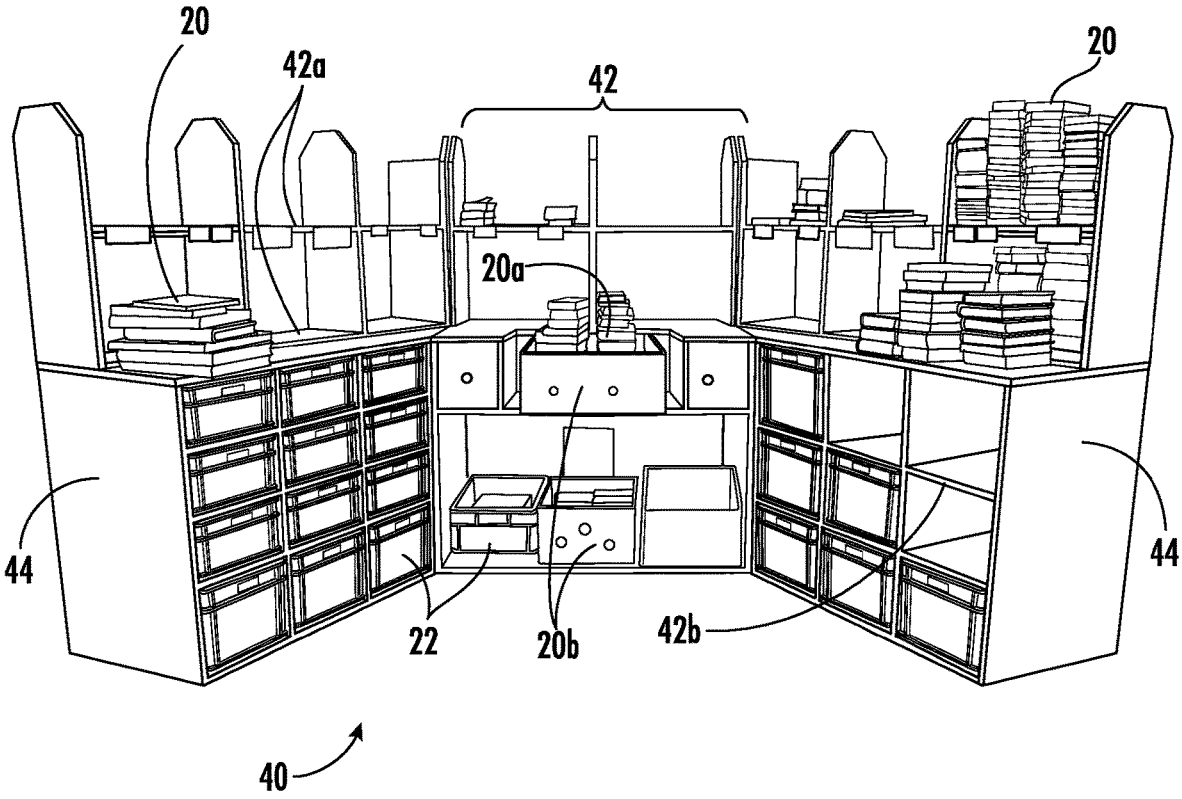
FIG. 6 is a second level sorting desk (SD unit), comprised of a pair of shelf wings on either side of a central workstation.
Figure 7:
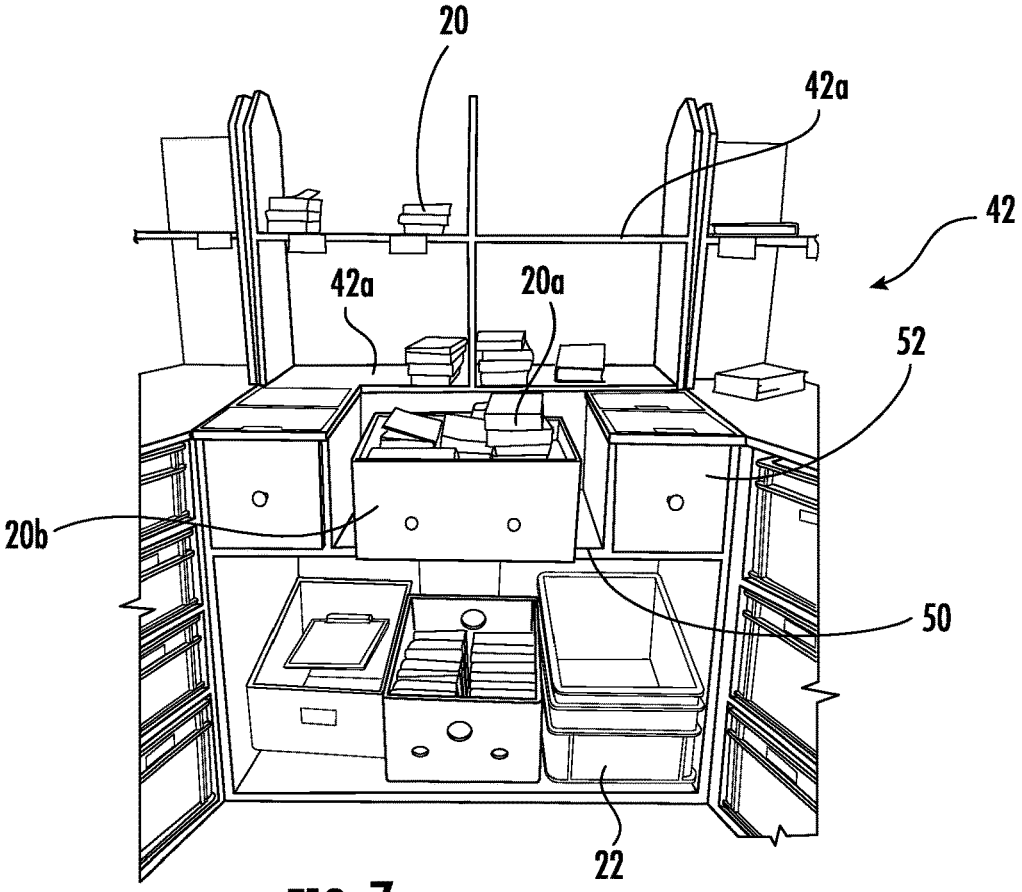
FIG. 7 is a front view of the central workstation of the SD unit.
Figure 8:
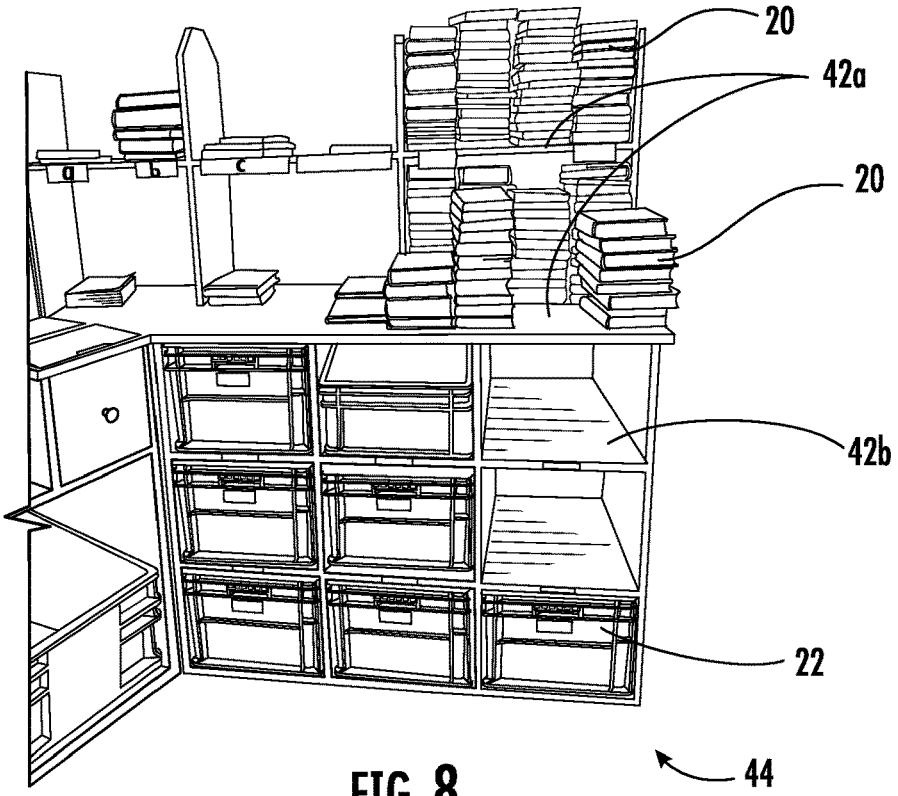
FIG. 8 is a front view of one wing of the SD unit.
Figure 9:
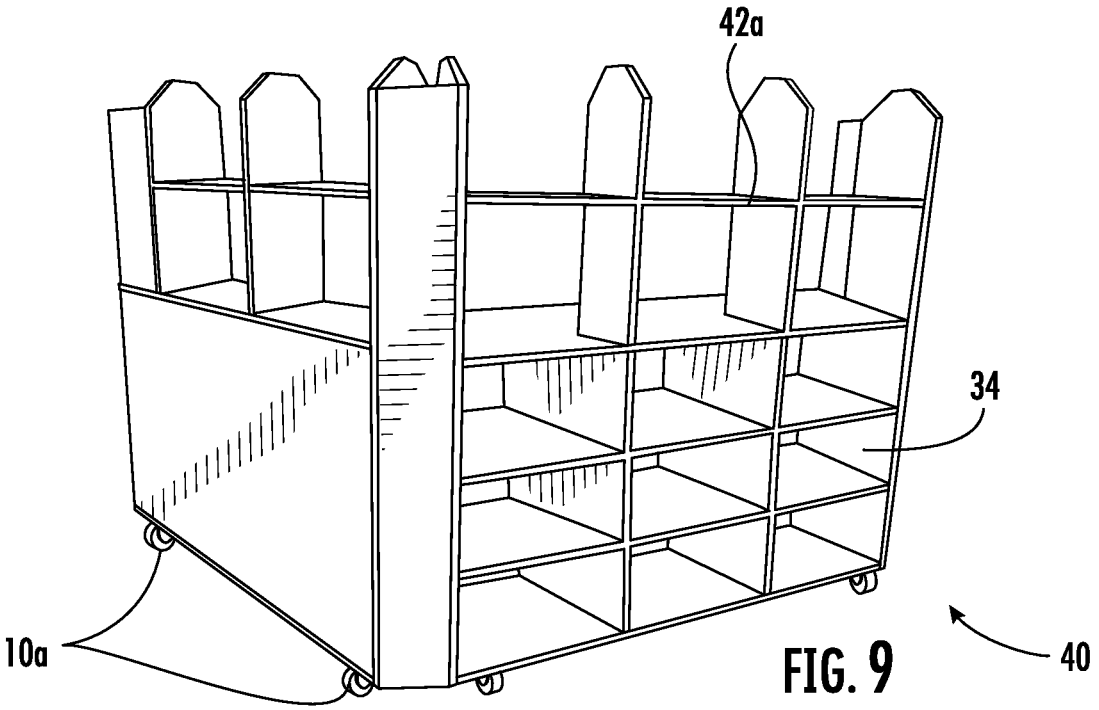
FIG. 9 is a back perspective view of the SD unit, shown with suggested locations for through-slots.

The back side of the GAP unit mimics the front side, with an upper area featuring the plurality of sorting shelves 18 and an additional workstation 26 positioned centrally to allow items to be further sorted and processed. Note that the upper area of the back side of the GAP unit 10 can identically mimic the front side, and is designed for other equipment such as a printer (not shown) to be supported on the workstation shelf 12 for printing labels 26*a*, invoices or other information relating to the sorted items. The back work surface 24*b* is about 1 inch deeper than the width of the box 22 to allow secure positioning on the back work surface 24*b*. The back work surface 24*b* is also about 1 inch higher than the front work surface 24*a*, with the back work surface 24*b* taller so as to allow access to the uppermost wall of the box 22 sitting on the front work surface 24*a* as shown in FIG. 4. The Figures show the back work surface 24*b* having a raised central ledge portion 24*c* with space directly beneath to accommodate the box 22, drawer style.

Looking at FIG. 4, the GAP unit 10 is shown with a vertical upper side wall 30 supporting the plurality of sorting shelves 18 and a lower side wall 36 having an angled wall or edge 32 sloping downwards on the front side of the GAP unit 10. The front work surface 24*a* on the front side of the GAP unit 10 is lower relative to the height of the back work surface 24*b* on the back side of the GAP unit 10 by about 8¾ inches, slightly more than the height of the box 22. This height difference is designed to ensure the user (not shown) has a same comfortable working surface height on either side of the GAP unit 10. Note that all the approximate stated sizes in this disclosure are based on dimensions of a Buckhorn box, made by Buckhorn Inc, with a website at https://buckhorninc.com. The particular box used here is model SW241608, with the following dimensions 24"×15"×7". In the GAP unit 10, the slots 34 are sized and shaped so as to position the Buckhorn box with its 24" side oriented so as to be parallel to a slot length, thus with a typical slot 34 using this box being about 48" long, between 15.5" to 16.5" wide and at least 7" tall. This particular Buckhorn box was used during testing and is the basis for the dimensions of the separate units 10 40 of the sorting assembly shown in the Figures and described herein. The angled wall 32 sloping along the front side of the GAP unit 10 allows the user to visually differentiate between front and back sides, and is one example of how the front and back sides can be easily identified. Alternatively, the lower side wall can have a same profile front and back, and each side labelled can be used to designate front and back, or different colors used, so long as visual differentiation is achieved. The inventor believes angling the side wall is an elegant design solution to identification.

Turning to FIGS. 6-12, the second sorting unit or SD unit 40 is shown as being comprised of a central workstation 42 having a front side with a work surface 50, an optional drawer 52 for storing miscellaneous useful items such as writing utensils, a plurality of upper sorting shelves 42*a*, and a plurality of lower sorting shelves 42*b* for box 22 20*b* storage. In a typical configuration, the central workstation 42 is flanked on either side by a side wing workstation or wing 44 having sorted item shelves 42*a* and lower shelves 42*b* or slots 34 holding GAP sorted items 20 but instead of a work surface, each wing 44 is typically designed as storage of sorted items. When positioned together, the wings angle inwards to create an approximately concave station, its shape providing more efficient accessibility by the user standing at the central workstation 42 by minimizing travel of the user handling SD unit sorted items 20. The inventor notes that more wings 44 and central workstations can be added, as needed, to more quickly sort items by accommodating more users. The SD unit 40 is configured like the GAP unit 10 to be accessible from both the front side and a back side. The sorting shelves 42*a* are open on both the front and back sides of the SD unit 40 and temporarily store sorted items 20. In embodiments where the lower shelves are in fact slots 34, the boxes 20*b* 22 can be stored or accessed from either side.

After sorting items with the SD unit 40, the sorted items 20 are moved into boxes 22 and positioned immediately into the storage unit 62 for longer term storage, or into display units 60 ready for sale, as shown in FIGS. 10-12. The sorted items 20 in the display unit 60 are conveniently visible for sale purposes and easily removed when the sale is finished and the boxes 22 are stored in the storage unit 62. The inventor notes that the display unit 60 is typically on wheels 10*a* to allow easy moving of the unit 60, and also that as an alternative embodiment, the display unit 60 may be a comprised of a wheeled base sized and shaped to receive a plurality of boxes 22 stacked on top of one another such that an open side of the box is positioned sideways to allow access to its contents. The storage unit 62 may be comprised of a plurality of drawer slots as shown in FIG. 11, or alternatively, be configured as long shelves with a depth compatible with the box 22 length to allow the boxes 22 to be accessed easily.

The boxes 22 used by the GAP unit 10, SD unit 40, display unit 60 and storage unit 62 are uniform in size and shape and have no lids. The boxes 22 shown in the Figures are stackable and strong, made of structural plastic and are similar to plastic milk crates. The inventor likes the Buckhorn box, but also believes any set of uniformly sized and shaped strong boxes can be used and the boxes shown are one size and shape that worked well during testing. For the embodiment where the boxes 22 themselves form the display unit 60, opposed side of the boxes can be constructed with mating structures to allow the boxes to stack securely atop one another and allow fast build up and break down of the units 60. The inventor believes the boxes 22 could also be made of cardboard, such as banker's boxes or standard sized file boxes, however, he stresses that any box used must be strong enough to withstand the weight of the items and not crush or fall apart when sitting on its side in a display orientation as shown in FIG. 10. A plurality of boxes whose dimensions differ from those of the Buckhorn box would require modification of the sorting assembly's various units. From the inventor's perspective, no other type of box works as well as the Buckhorn box.

The GAP unit 10 and the SD unit 40 are designed to be used together to provide a minimum of two levels of sorting for the items and the type of sorting parameters used are selectable by the user. For instance, the GAP unit 10 as shown in the Figures is used to for a first level of sorting of items, such current market value. The SD unit 40 is then used to sort the first level sorted items using another grouping designation, for instance, reading level.

The inventor stresses that his sorting assembly 100, minimally comprising the GAP unit 10 and the SD unit 40, is shown in the Figures as sorting items 20 20*a* identified as books and other print type media. Items 20 20*a* include a wide variety of physical things, including toys, collectibles such as teacups, figurines and other things. The user is free to decide as to the type of grouping designations desired and use the GAP unit 10 and SD unit 40 accordingly. The inventor notes that it is possible to use just the GAP unit 10 or the SD unit 40 separately without the other however the use of both together provides superior sorting by allowing relatively small numbers of people (minimally two) to efficiently sort and process thousands of items using two-level sorting criteria in days rather than weeks, and then set up and tear down a book or other sale with the sorted items quickly with minimal effort and chaos. Sorting and organizing of items can thus be done offsite of the sale location, then quickly set up with the boxes 22 positioned in the display units 60. Both the GAP unit 10 and the SD unit 40 enable a pair of users to work simultaneously at the same unit. The number of GAP units 10 and SD units 40 is increased to accommodate larger volumes of material to be sorted as well as number of users, hence the sorting assembly 100 is scalable. A single GAP unit 10 can for instance be paired with multiple SD units 40, or vice versa, and the SD units 40 can include 3 or more wings or multiple central workstations and wings as needed. The sorted items 20 arranged in the display units 60 allows a bookseller or other seller to visually estimate sales with a simple glance at the number of empty boxes and their identifying groupings, such as price, type of item, etc. in a way that the currently used manual systems cannot so easily accomplish. The rolling units 10 40 60 62 allow the user to sort items and set up or tear down a book or miscellaneous item sale in virtually any convenient location that is large enough to accommodate the sorting assembly, and to arrange the units as needed to accommodate the dimensions of the room as well as the needs of the users doing the sorting work.

It is to be understood that the above-described arrangements are only illustrative of the application of the principles of the present invention. Numerous modifications and alternative arrangements may be devised by those skilled in the art without departing from the scope of the present invention. For instance, the inventor notes that the modular nature of the sorting assembly 100 allows item sorting to be scaled up or down as needed, and thus any number of GAP units, or SD units and wings may be used together. The sorting assembly 100 shown in the Figures shows a basic or typical arrangement, but the modular nature of the assembly allows for many variations. The inventor also notes that the computer shelf 12 does not need to hold a computer, but rather could be a touch screen display or other equipment, such as a printer, as needed for sorting items, or even a camera. The inventor uses his assembly for sorting books, vinyl records, magazines and other media, but it can be easily used to also sort toys, housewares, figurines, trading cards, and even clothing, and all within a same unsorted box. Hence, purchasing lots from estate sales are easily sorted using the assembly and the entire process of sorting, displaying, selling and removing the unsold items can be done easily and quickly on site or in another location. The inventor also believes that wheels on the units allow for easy arrangement and transport of the assembly, however the units could also be adapted to have feet suitable for sliding that would allow the units to be easily moved.

I claim:

1. A sorting assembly for use with a box having box width, a box length and a box height, with the box length having a length measurement greater than a width measurement of the box width, and an item to be sorted into the box, the sorting assembly comprising:

a first level sorting unit having a first unit front side, a first unit back side, and a first unit width;

wherein the first unit width is measured from a front edge of the first unit front side to a back edge of the first level back side;

a first unit left side and a first unit right side, and a first unit length;

wherein the first unit length is measured from the first unit left side to the first unit right side;

wherein each of the first unit front and back sides is further comprised of a first unit upper storage area and a first unit lower storage area separated by a first unit work surface;

wherein the first level sorting unit has at least two or more shelves on the upper storage area each spanning at least 30% of the first unit length;

wherein the first unit work surface is further comprised of a first unit work surface front side and a first unit work surface back side, the first unit work surface front side having a front surface length at least equal to the box width and a front surface width at least a same measurement as the box length;

wherein the first unit lower storage area is divided into at least two through-slots, each through-slot having a slot width and a slot height sized and shaped to receive the box width and box height, and a slot length equal to at least two box lengths, with a slot front opening accessible from the first unit front side, and a slot back opening accessible from the first unit back side; and a second level sorting unit having a central workstation with a side wall and an immediately adjacent wing, each of the central workstation and the wing having a second unit front side and back side, and a second unit work surface dividing each of the central workstation and the wing into a second unit upper storage area and a second unit lower storage area;

wherein each of the second unit lower storage areas of the central workstation and of the wing has at least one of a through-slot or shelf sized and shaped to receive the box;

wherein the second unit upper storage area is comprised of shelves sized and shaped to temporarily store items to be later placed in the box;

wherein the shelves of the second unit upper storage area are accessible from a front side and a back side of the central workstation and wing; and wherein the first level sorting unit and the second level sorting unit each are further comprised of wheels along a floor facing side of each unit, whereby each unit is repositionable and moveable without further equipment.

2. The sorting assembly in claim 1, wherein the wing and central workstation unit are separate units.

3. The sorting assembly in claim 1, further comprising a second wing positioned on an opposed side of the central workstation whereby the second level sorting unit has a concave tripartite structure.

4. The sorting assembly in claim 1, wherein the wing has an extended side wall sized and shaped to be positioned immediately adjacent the side wall of the central workstation so as to position the second unit front side of the wing towards a user standing in front of second unit front side of the central workstation, whereby lateral movement of the user is minimized in order to move the item from the central workstation to the wing.

5. The sorting assembly in claim 1, wherein the first unit upper storage area is further comprised of at least one of a computer workstation shelf and a power source.

6. The sorting assembly in claim 1, further comprised of an integral light source positioned in the first unit upper storage area.

7. The first level sorting unit in claim 1, further comprising a pair of opposed walls vertically positioned at the first unit left and right sides of the first unit lower storage area, each wall of the pair of opposed walls having a front facing top wall and a back facing top wall;

wherein the front facing top wall has at least one of a different shape and color than the back facing top wall, whereby the front facing and back facing walls of the first unit left and right sides are visually differentiated.

8. The first level sorting unit in claim 7, wherein the front facing top wall is angled downwards about 45 degrees from a horizontal plane extending from the back facing top wall, the horizontal plane being parallel to a ground surface.

9. The sorting assembly in claim 1, further comprising a display unit having at least two shelves sized and shaped to receive and store at least two boxes positioned adjacently on the shelves so that their box openings face sideways towards an open accessible side of each shelf, and further comprising wheels affixed to a floor-facing side of the unit, whereby the unit is repositionable.

10. The sorting assembly in claim 1, further comprising a storage unit having a plurality of through-slots, each through-slot sized and shaped to receive at least one box.

11. The sorting assembly in claim 1, wherein the first unit back side is further comprised of a raised centralized work area having a slot sized and shaped to receive and store one box accessible from one side of the slot.

12. The sorting assembly in claim 1, wherein the first unit lower storage area is further comprised of a shelf sized and shaped to receive at least one of the box and at least one container having a size and shape different from that of the box.

13. The sorting assembly in claim 1, wherein the second unit upper storage area has an uppermost shelf having an open top side.

14. The sorting assembly in claim 1, wherein the second unit lower storage area of the central workstation has at least one shelf sized and shaped to receive and store at least one secondary box.

* * * * *